United States Patent [19]

Nakashima et al.

[11] Patent Number: 4,559,268

[45] Date of Patent: Dec. 17, 1985

[54] FILAMENT FOR BRUSHMAKING

[75] Inventors: Hiroyuki Nakashima, Takasago; Atuyoshi Tamura; Yoichi Kanbara, both of Kakogawa; Masaharu Fujii, Takasago, all of Japan

[73] Assignee: Kanegafuchi Kagaku Kogyo Kabushiki Kaisha, Osaka, Japan

[21] Appl. No.: 626,798

[22] Filed: Jul. 2, 1984

[30] Foreign Application Priority Data

Jul. 4, 1983 [JP] Japan ..... 58-121933

[51] Int. Cl.[4] ..... D02G 3/00; A46B 13/20

[52] U.S. Cl. ..... 428/397; 428/398; 15/159 A

[58] Field of Search ..... 428/397, 398; 15/159 A

[56] References Cited

U.S. PATENT DOCUMENTS

| | | | |
|---|---|---|---|
| 2,476,293 | 7/1949 | Hall et al. | 428/398 |
| 2,907,096 | 10/1959 | Halbig | 428/398 |
| 4,020,227 | 5/1977 | Cox, Jr. | 428/398 |
| 4,279,053 | 7/1981 | Payne et al. | 428/398 |

*Primary Examiner*—George F. Lesmes
*Assistant Examiner*—Beverly K. Johnson
*Attorney, Agent, or Firm*—Armstrong, Nikaido, Marmelstein & Kubovcik

[57] ABSTRACT

A filament for brushmaking which is excellent in yield and in bend recovery, and when used in making paintbrushes, can give brushes with good paintability.

A filament has a specified cross section having a plurality of cavity of hollow structures, the hollow ratio being 20 to 60% based on the whole cross-sectional area, capable of affording greater yield, ready processability at its end, excellent stiffness and excellent cleanability.

7 Claims, 6 Drawing Figures

FILAMENT FOR BRUSHMAKING

BACKGROUND OF THE INVENTION

The present invention relates to a filament for brushmaking, which has a specified cross section, is excellent in yield in stiffness, and in bend recovery, and when used in manufacturing paintbrushes, can give an excellent property profile such as paintability or paint pick-up.

Hitherto, hog bristles, goat hair and horse hair have been used as materials for brushmaking. Recently, synthetic filaments also have come into common in use as such materials. Brushes employing synthetic filaments have a number of advantages, such as stability or consistency in quality and supply, and therefor the demand and uses are expanding.

When used in manufacturing paintbrushes which are in great demand among brushes, synthetic filaments give brushes comparable in characteristic properties to brushes in which hog bristles are used. They are generally tapered or processed at their ends so that they can paint well, facilitate paint release and retain their stiffness during painting. They are currently available in basic cross section, such as circular, elliptic, triangular, Y-shaped, flat, cruciform, modified cruciform, three-leafed, four-leafed, cogwheel-shaped, circularly hollow and porously hollow. Among such conventional cross-sectional shapes, the rib type which has a plurality of projections is disadvantageous in that said projections engage one another to thereby make the filament crunching and disagreeable to the touch. Although the hollow filament is good in processability at its end, has small bulk density, and is of light weight, hence advantageous from the practical viewpoint, the hollow shapes are also disadvantageous in that once broken under a bending moment the filament cannot revert to its original shape for reasons of their cross-sectional structure, namely the periphery is welded completely, and in that since the filament is hollow, the paint which has entered the inside of the hollow filament at the end thereof can hardly come out.

It is an object of the present invention to provide a filament for brushmaking, which has a cross section capable of affording good yield, good processability, good bend recovery and good paint cleaning.

These and other objects of the present invention will become apparent from the description hereinafter.

SUMMARY OF THE INVENTION

The present inventors have found that a filament having a specified cross section is best suited for the intended use.

In accordance with the present invention, there is provided a filament for brushmaking made of a thermoplastic polymer, which is characterized by its cross section having a plurality of cavity or hollow structures, each of the structures having, on its periphery, at least one place of line-to-line or line-to-point of line contact and the hollow ratio being 20 to 60% based on the whole cross-sectional area.

The phrase "line-to-line or line-to-point of line contact" as used herein refers to the cross section of the filament and, with respect to the actual state of filament, it means "face-to-face or face-to-linear end of face contact".

DETAILED DESCRIPTION

Figure 1:
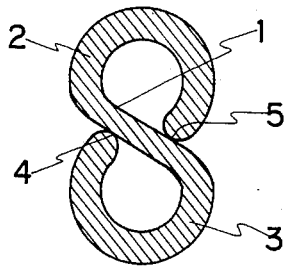
FIG. 1, FIG. 2, FIG. 3 and FIG. 5 are the cross-sectional view of a filament according to the present invention, respectively.

A typical example of the filament cross section according to the present invention is as shown in FIG. 1. In FIG. 1, the cross section involves two hollow structures and each structure has one line-to-point of line contact place. On the other hand, the hollow structures shown in FIG. 2 and FIG. 3 have a face-to-face contact place, respectively.

The filament for brushmaking according to the present invention has advantages of hollow filaments but is free from disadvantages of conventional hollow filaments. Thus, the filament provided by the invention is advantageous in that it is excellent in yield and light. While conventional hollow filaments are easily broken by bending upon exposure to a bending moment during brush cleaning, the filament according to the present invention is resistant to breaking and, when the bending moment is removed, it easily reverts to its original shape, since upon exposure to a bending moment, its cross section can easily be altered, for example, loses its hollowness. Moreover, unlike conventional hollow filaments, the hollow structures of the filament according to the invention can easily be altered so as to communicate with the outside and thereby make it easy to clean that portion of paint which is present within the hollow structures.

Figure 4:
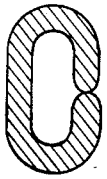
FIG. 4 is the cross-sectional view of a filament outside the scope of the invention.

Referring to the contact place on the periphery of each of the above-mentioned hollow structures according to the invention, the line-to-point of line contact type is preferred to the line-to-line contact type because of a tendency toward excellent yield. A structure that two points of line contact each other, such as shown in FIG. 4, is disagreeable because the hollow structure is readily disturbed.

The filament according to the present invention preferably has a uniform wall thickness as far as possible, because a uniform wall thickness facilitates the processability such as tipping, flagging and finishing and, as a result, the paintability is improved.

The wall thickness is preferably within the range of 0.01 to 0.5 mm, and it is desired that the uniformity in wall thickness should be controlled within the range of $\pm 10\%$. For the purpose of processing at the end of filament, it is preferable that the cross section has no branched part. From the viewpoint of resistance to breakage or cleavage, it is preferable that the cross section is free of acute angles.

The structure shown in FIG. 1 is a typical representative of the cross-sectional structures which meet such various preferred conditions. As shown in FIG. 1, the cross-sectional structure may be defined as a structure made up of a middle line (1) (which is not necessarily a straight line) and two curved lines extending from both ends (2) and (3) of the line (1) to the opposite sides of the line (1), until they contact the line (1) to thereby form two hollow structures. Such cross-sectional structure (hereinafter referred to as "cross-sectional structure A") is free of acute-angle parts and can be uniform in wall thickness In this case, it is preferable from the viewpoint of volume that the contact points (4) and (5) of the curved lines with the line (1) are located such that, as-shown in FIG. 1, the contact point (5) at which the curved line from the end (2) arrives is closer to the end (3) as compared with the contact point (4).

Figure 2:
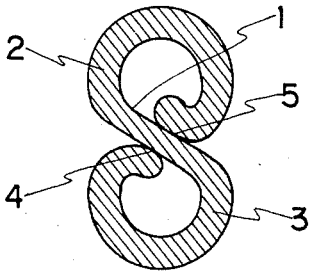
Figure 3:
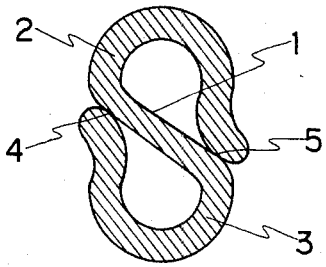

Referring to the cross-sectional structure A, it is most preferred that, as shown in FIG. 1, the contact points (4) and (5) are of the line-to-point of line contact type, respectively. In other words, the ends (2) and (3) meet and contact the middle line (1) at the tip of said ends. Nevertheless, the cross-sectional structure A also includes those structures in which the curved lines extend beyond the respective contact points (4) and (5), as shown in FIG. 2 (the contact points (4) and (5) therefore being of the line-to-line contact type, respectively). In this case, the ends (2) and (3) curve inwardly to contact the middle line (1). In FIG. 3, the curvature is outward. When the structure shown in FIG. 2 or FIG. 3, particularly FIG. 3, is employed, care should be paid lest the lines extending beyond the contact points toward the outside of the respective hollow structures cause a feeling of crunching.

Figure 5:
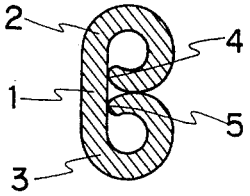

As shown in FIG. 5, a cross-sectional structure made up of a middle line (1) and two curved lines extending from both ends (2) and (3) of the line (1) to the same sides of the line (1) (not to the opposite sides as in the cross-sectiohal structure A), until they come in contact with the line (1) to thereby form two hollow structures is also preferred to some extent. Such cross-sectional structure (hereinafter referred to as "cross-sectional structure B"), like the cross-sectional structure A, also includes those structures in which the curved lines extend beyond the contact points (4) and (5), respectively. In this case, it is preferable that the curved lines are terminated at the contact points (4) and (5), respectively, as shown in FIG. 5.

The filament according to the present invention generally has a cross-sectional area of 0.01 to 5 $mm^2$, of which 20 to 60% is accounted for by cavities (i.e. hollow ratio: 20 to 60%).

When the hollow ratio is lower than 20%, the volume is unsatisfactory, the wall thickness of the filament in cross section is great, and accordingly the filament is lacking in flexibility and processability, and the paint release performance is deteriorated. When the hollow ratio is greater than 60%, the wall thickness becomes small and monofilament cleavage and breakage occurs, and the quality of the filament as the paintbrush is lowered.

For use in brushmaking, the filament according to the invention is cut to a length of about 1 to 15 cm. In some instances, it is advantageous to taper the filament, i.e. the filament is cut on the paint pick-up side, namely at the tapered end. In that case, the diameter ratio between the base and the tapered end is generally in the range of 1.5 to 4.0.

The material of the filament according to the present invention is not particualrly limited, but preferably is used a nylon, polyester, polypropylene, acrylic or modacrylic filament.

For producing a filament having the cross-sectional structure according to the invention, for instance, as shown in FIG. 1, an S-shaped nozzle is preferrably employed in view of possible deformations after extrusion through the nozzle. In this case, the nozzle shape should be determined with due consideration of the fact that the deformation after extrusion is negligible in melt spinning, great in wet spinning and intermediate in dry spinning.

The filament for brushmaking according to the present invention, particularly the one having the cross-sectional structure A or B, produces the above-mentioned effects as a material for brushmaking and moreover is excellent in feel and lubricity as well as in flexibility or high modulus of the processed end, can easily be processed at its end because of uniformity in wall thickness and, consequently, is satisfactory in paintability.

The present invention is more specifically described and explained by means of the following Example. It is to be understood that the present invention is not limited to the Example, and various changes and modifications may be made in the invention without departing from the spirit and scope thereof.

EXAMPLE

An acrylonitrile copolymer composed of 50 weight percent of acrylonitrile and 50 weight percent of vinyl chloride was dissolved in acetone in a resin concentration of 25% by weight. Using thus prepared dope and an S-shaped nozzle, spinning was carried out in the acetone-water system at a draft ratio of 1.0 or 1.5. The filament was dried at 120° C. (248° F.), subjected to stretching to 200% under elevated temperature and then heat-aged at 145° C. (239° F.) for 5 minutes. Thus obtained filament had a cross section similar to that shown in FIG. 1, for which the hollow ratio was calculated according to the following equation:

$$\text{Hollow ratio (\%)} = \frac{\text{Total area of hollow part}}{\text{Whole cross-sectional area}} \times 100$$

The filament obtained in the above procedure was cut to a length of 9 cm and subjected to a process for flagging and finishing. The filament pieces thus obtained were subjected to performance testing. Good results were obtained as to hollow ratio within the range of 20 to 60%. They were good in lubricity and feeling to the touch. The results are summarized in Table 1.

TABLE 1

| | Draft ratio | |
|---|---|---|
| | 1.0 | 1.5 |
| Hollow ratio | 28% | 39% |
| Cross-sectional area | 0.08 $mm^2$ | 0.04 $mm^2$ |
| Wall thickness | 0.09 mm | 0.05 mm |
| Uniformity in wall thickness | Almost uniform | Almost uniform |
| Processability in flagging and finishing | excellent | excellent |
| Paintability | " | " |
| Bend recovery, stiffness | " | " |

The paintability was evaluated in the following manner. The brush was dipped, to one third of the bristle length, in a water-based paint, and the paintability testing was performed at a ⅜ inch touch and 6/8 inch touch and a speed of 25 cm/second. The paintability was evaluated in terms of the area covered with the paint.

Figure 6:
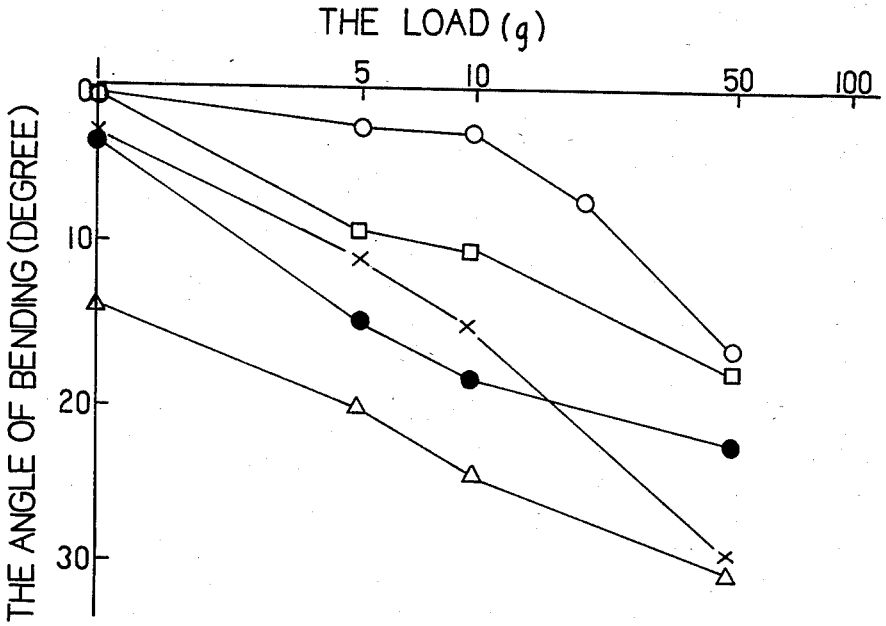
FIG. 6 is a graphic representation of the results obtained in the example, indicating that the filament according to the present invention is resistant to bending. The ordinate is for the angle of bending and the abscissa is for the load in grams.

The monofilament of the present invention obtained at the draft ratio of 1.5 as well as commercially available conventional filaments were tested for tendency toward bending. Good results were obtained with respect to the monofilament of the invention, as shown in FIG. 6.

The above test was performed by fixing the monofilament on a holder of the measuring apparatus so that the monofilament protruded from the holder edge by 35 mm, a load was applied to the free end of the monofilament, the load was removed 5 seconds later, and after a period of 5 minutes, the angle of bending was measured.

In FIG. 5, each mark has the following meaning:

○——○ Filament having a cross section according to the invention, corresponding to 12 mil ●——● Conventional hollow filament made of polyester in 12 mil □——□ Conventional hollow filament made of nylon in 12 mil ×——× Conventional hollow filament made of polypropylene in 12 mil △——△ Conventional hollow filament made of polyester in 10 mil

What we claim is:

1. A filament for brushmaking made of a thermoplastic polymer and having a plurality of cavities or hollow structures, a lateral cross section of the filament having at least two end sections and a middle section, each of said end portions being bent in a continuous curve so as to meet and contact said middle section thereby defining said cavities or hollow structures, and the cross-sectional area of said cavities or hollow structures being 20 to 60% of the cross-sectional area of the filament.

2. A filament as defined in claim 1 having two end sections which meet and contact said middle section on opposite sides of said middle section.

3. A filament as defined in claim 1 having two end sections which meet and contact said middle section on the same side of said middle section.

4. A filament as defined in claim 2 wherein said end sections each have a tip and meet and contact said middle section at said tip.

5. A filament as defined in claim 2 wherein said end sections each have a tip and meet and contact said middle section other than at said tip.

6. A filament as defined in claim 5 wherein said end sections curve inwardly to contact said middle section.

7. A filament as defined in claim 5 wherein said end sections curve outwardly to contact said middle section.

* * * * *